US012108833B2

(12) United States Patent
Feller et al.

(10) Patent No.: US 12,108,833 B2
(45) Date of Patent: Oct. 8, 2024

(54) PULL-ON BOOT

(71) Applicant: RED WING SHOE COMPANY, INC., Red Wing, MN (US)

(72) Inventors: Craig Lee Feller, Red Wing, MN (US); Justin David Behnke, Red Wing, MN (US); Russell L. Davis, Danville, CA (US)

(73) Assignee: RED WING SHOE COMPANY, INC., Red Wing, MN (US)

( * ) Notice: Subject to any disclaimer, the term of this patent is extended or adjusted under 35 U.S.C. 154(b) by 0 days.

(21) Appl. No.: 16/875,221

(22) Filed: May 15, 2020

(65) Prior Publication Data

US 2020/0359747 A1 Nov. 19, 2020

Related U.S. Application Data

(60) Provisional application No. 62/848,343, filed on May 15, 2019.

(51) Int. Cl.
*A43B 23/02* (2006.01)
*A43B 23/04* (2006.01)

(52) U.S. Cl.
CPC ..... *A43B 23/047* (2013.01); *A43B 23/021* (2013.01); *A43B 23/0245* (2013.01); *A43B 23/027* (2013.01)

(58) Field of Classification Search
CPC ..... A43B 3/04; A43B 3/08; A43B 23/0245; A43B 23/027; A43B 23/045; A43B 23/047; A43B 23/021
See application file for complete search history.

(56) References Cited

U.S. PATENT DOCUMENTS

| | | | | |
|---|---|---|---|---|
| 378,988 | A * | 3/1888 | Warren | A43B 23/047 36/51 |
| 2,343,477 | A | 3/1944 | Ross | |
| 2,507,726 | A * | 5/1950 | L'Hollier | A43B 3/04 36/45 |
| 3,657,757 | A * | 4/1972 | Vilder | A43B 3/04 12/146 C |
| 6,367,171 | B1 * | 4/2002 | Burt | A43B 3/102 36/100 |
| 6,665,954 | B2 | 12/2003 | Chen | |
| 7,980,010 | B2 | 7/2011 | Davis et al. | |
| 9,254,014 | B2 | 2/2016 | Weitzman | |
| 9,282,781 | B2 | 3/2016 | Davis et al. | |
| 9,456,652 | B2 | 10/2016 | Davis et al. | |
| 2008/0083138 | A1 * | 4/2008 | Lacorazza | A43B 23/0255 36/97 |
| 2010/0031534 | A1 * | 2/2010 | Davis | A43B 11/00 36/102 |
| 2010/0180474 | A1 * | 7/2010 | Clark | A43B 13/223 36/3 B |
| 2011/0078924 | A1 * | 4/2011 | Rackiewicz | A43B 7/12 36/102 |

(Continued)

*Primary Examiner* — Megan E Lynch
(74) *Attorney, Agent, or Firm* — Merchant & Gould P.C.

(57) ABSTRACT

The present disclosure provides a pull-on style boot that fits better for a larger number of people sharing the particular shoe size. The boot of the present disclosure has the ability to expand to adapt to the user's particular foot and lower leg geometry. The boot provides an improved dynamic and static fit and also facilitates foot entry and exit.

17 Claims, 6 Drawing Sheets

(56) References Cited

U.S. PATENT DOCUMENTS

| | | | | |
|---|---|---|---|---|
| 2012/0186106 | A1* | 7/2012 | Recchi | A43B 23/047 36/102 |
| 2013/0125420 | A1* | 5/2013 | Raghuprasad | A43B 23/28 36/97 |
| 2015/0173449 | A1* | 6/2015 | Weitzman | A43B 3/0036 36/102 |
| 2016/0192728 | A1 | 7/2016 | Crawford et al. | |
| 2016/0353829 | A1* | 12/2016 | Chen | A43B 23/028 |
| 2017/0215517 | A1* | 8/2017 | Silva | A43B 7/1475 |
| 2017/0215523 | A1* | 8/2017 | Nishiwaki | A43B 7/08 |
| 2018/0206597 | A1* | 7/2018 | Towey | A43B 23/047 |

* cited by examiner

PULL-ON BOOT

CROSS-REFERENCE TO RELATED APPLICATIONS

This application claims priority to U.S. Provisional Application No. 62/848,343 filed on May 15, 2019, the entire disclosure of which is hereby expressly incorporated herein by reference.

TECHNICAL FIELD

Pull-on boots with improved fit.

BACKGROUND

Most traditional western style boots, which are commonly referred to as cowboy boots, are pull-on boots. In addition, a large number of hunting, work, and winter boots are being constructed in the pull-on style. Pull-on style boots are designed to be pulled on and pulled off the user's foot. Typically, pull-on boots do not include a mechanism that allows for custom adjusting to the foot/leg volume such as laces, buckles, or zippers. Each pull-on boot is designed to fit the most common foot and leg configuration for that particular boot size. However, since the foot and leg configuration for people within a particular shoe size is not the same, the fit of pull-on style boots is less than ideal for a number of people. For example, for a person with a size 9 foot, a particular size 9 pull-on boot may fit a bit tight and constrict his or her instep, and for another person with a size 9 foot the same size 9 boot may fit a bit loose and feel sloppy. In addition, the ease or difficulty of pulling on and pulling off the boot can also be impacted by the user's foot and leg geometry. The boot of the present disclosure provides a pull-on boot with improved dynamic fit.

SUMMARY

The present disclosure provides a pull-on style boot that fits better for a larger number of people sharing the same shoe size. The boot of the present disclosure has the ability to expand to adapt to a user's particular foot and lower leg geometry. The boot provides an improved fit that facilitates foot entry and exit. It has these advantages while maintaining the simplicity in function and style, which is a draw of pull-on style boots.

DETAILED DESCRIPTION

Figure 1:
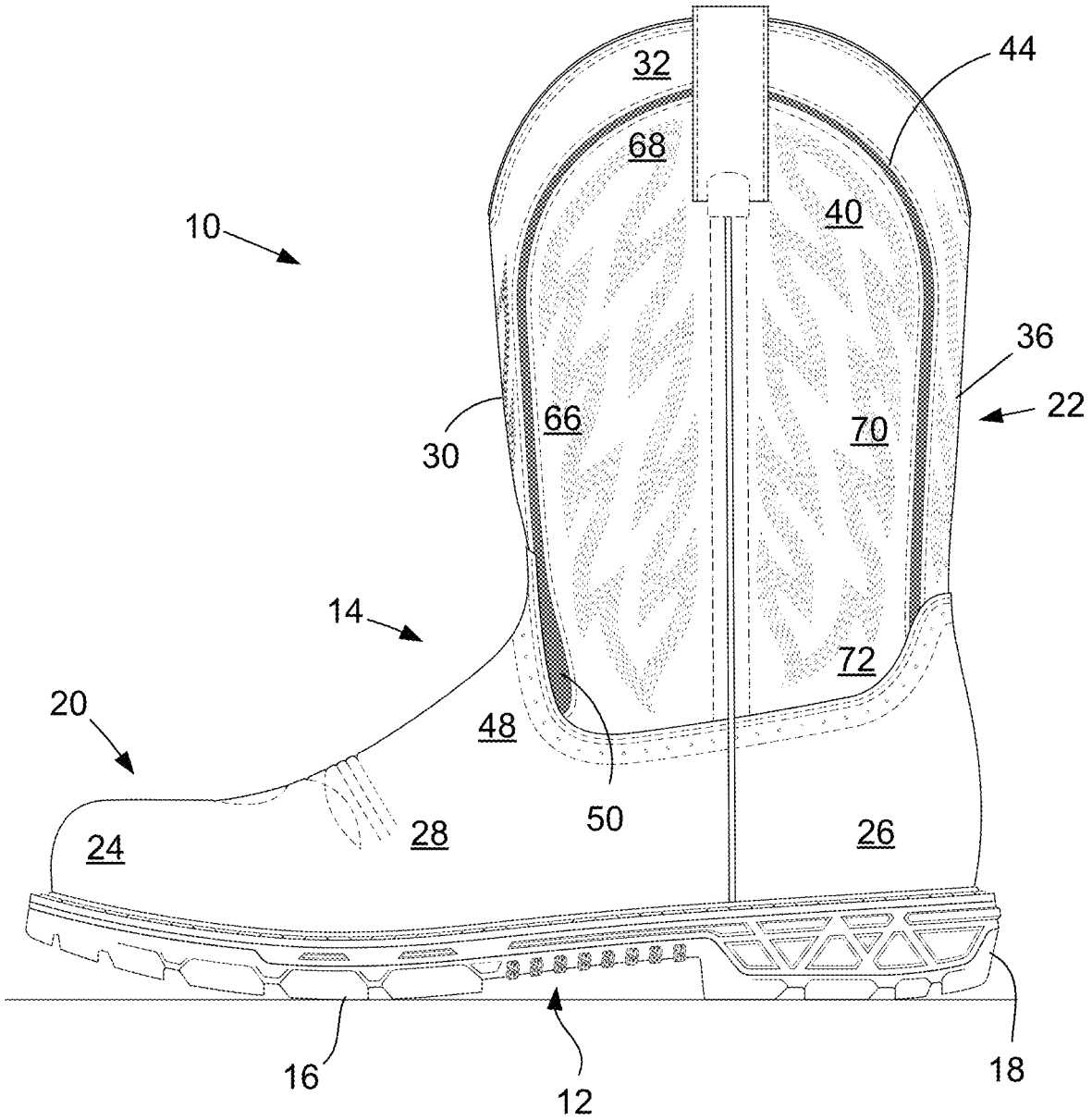
FIG. 1 is a medial side view of a boot according to the principles of the present disclosure.
Figure 2:
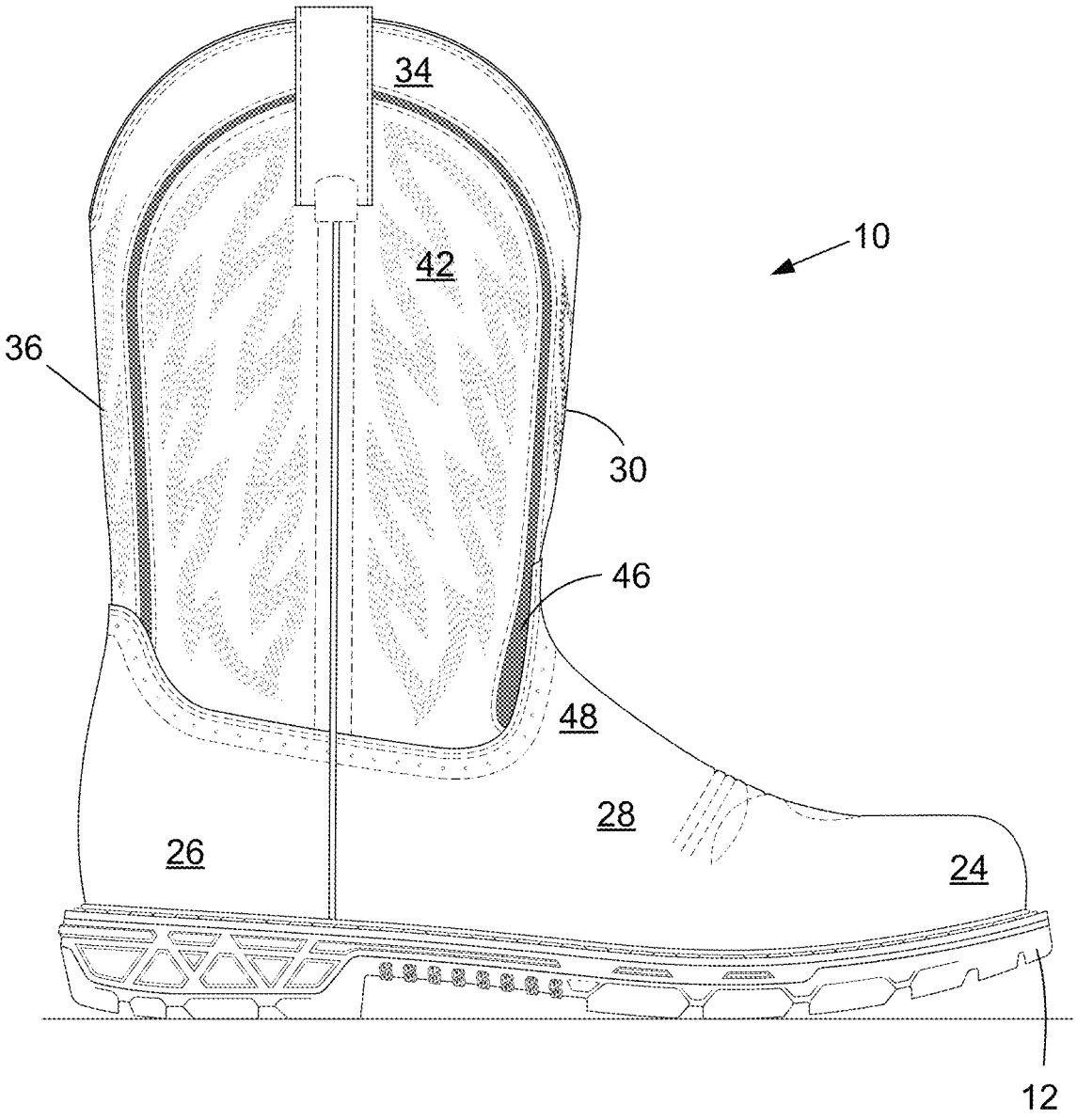
FIG. 2 is a lateral side view of the boot of FIG. 1.
Figure 3:
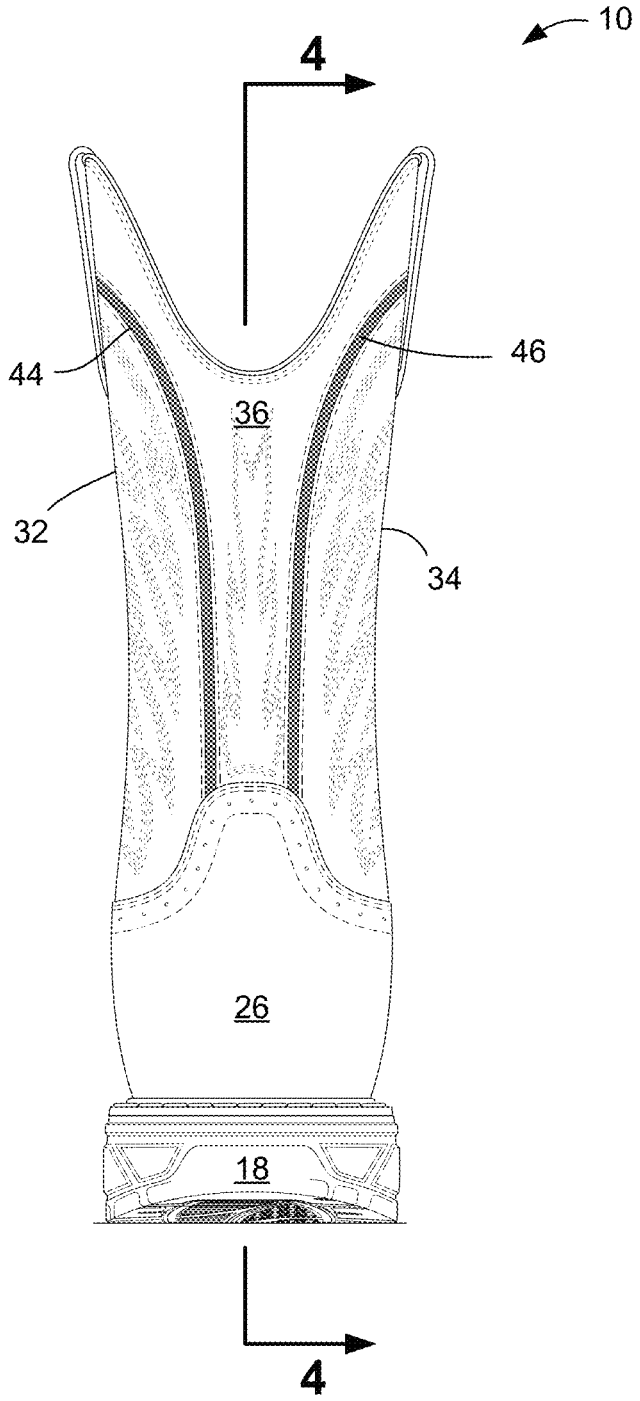
FIG. 3 is a rear view of the boot of FIG. 1.
Figure 4:
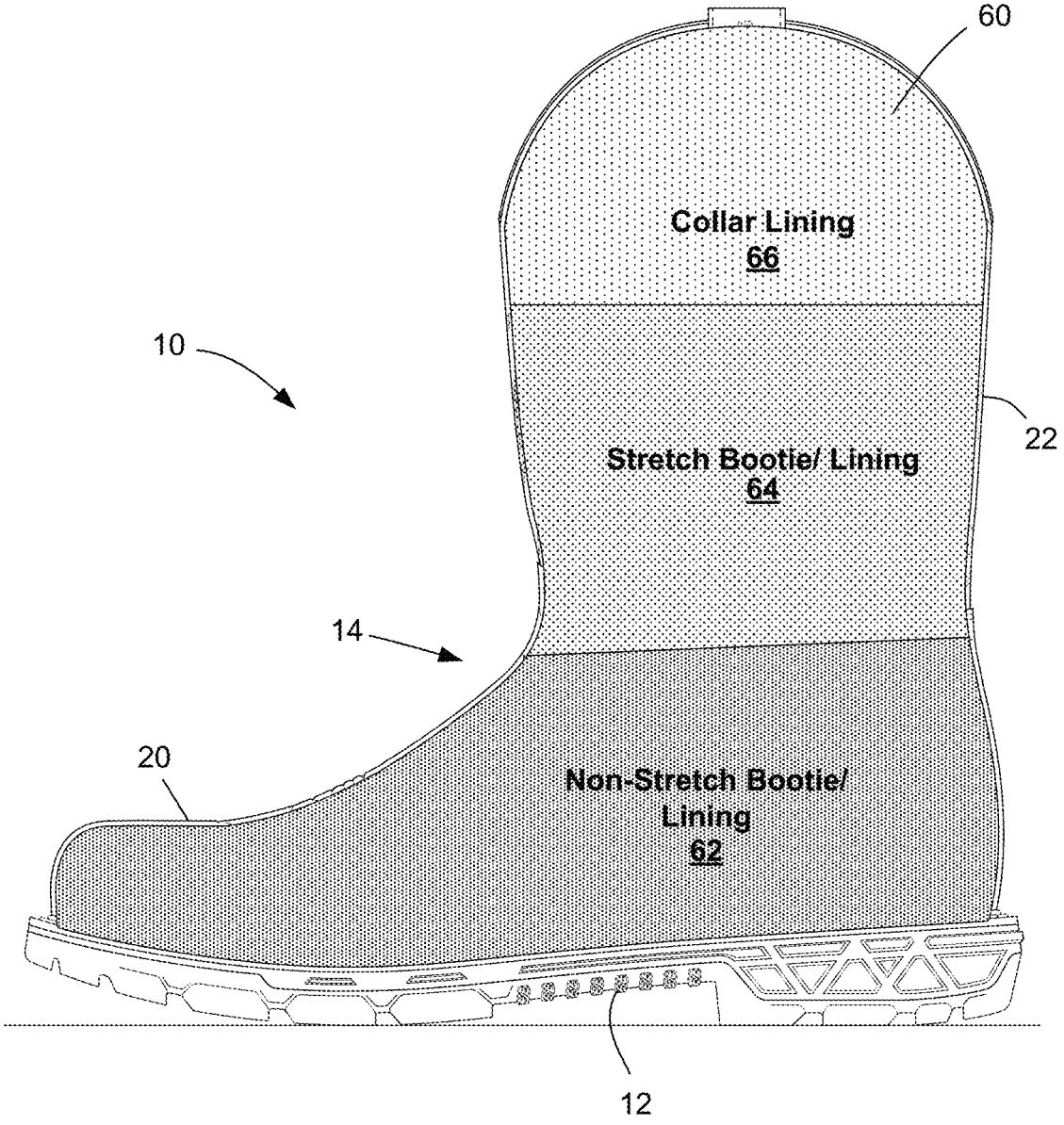
FIG. 4 is a cross-sectional view of the boot of FIG. 1.

Referring to the FIGS. 1-8, a pull-on boot according to the present disclosure is described in further detail below. The boot in the depicted embodiment is a western style pull-on boot. The boot is of the style that is commonly referred to as a "cowboy" boot. It should be appreciated that the principles of the present disclosure has applicability to many other styles of pull-on boots. For example, the features can be incorporated into hunting boots, work boots, and insulated winter boots. In addition, the features of the present disclosure can be incorporated into a hybrid style boot, for example, a boot that can be pulled, but also includes mechanical devices such as zippers, buckles and laces that can be used to open the boot or adjust the foot volume of the boot.

In the depicted embodiment, the boot 10 includes a sole 12 and an upper 14 connected to the sole 12. In the depicted embodiment, the sole 12 includes a forefoot portion 16 and a heel portion 18. In the depicted embodiment, the heel is a raised heel that is typical of western style boots. In the depicted embodiment, the boot 10 has a welt construction for securing the upper 14 to the sole 12. It should be appreciated that many other alternative sole and upper configurations are possible. For example, the boot 10 can have a flat sole 12 that is glued to the upper 14 instead of stitched to the upper 14. Numerous other configurations are also possible.

In the depicted embodiment, the upper 14 includes a foot covering portion 20 that is connected to the sole 12 and a lower leg covering portion 22 located above the foot covering portion 20. In the depicted embodiment, the foot covering portion 20 includes a toe covering portion 24, a heel covering portion 26, and an instep covering portion 28. In the depicted embodiment, the foot covering portion 20 has a leather construction. In the depicted embodiment, the foot covering portion 20 is shown as part of a vamp and the leg covering portion 22 is shown as part of a boot shaft. It should be appreciated that many other configurations are also possible.

In the depicted embodiment, the lower leg covering portion 22 includes a front portion 30 configured to cover a portion of the top of a user's foot and part of the user's shin, a medial side portion 32 configured to cover a portion of the medial side of a user's calf and ankle, a lateral side portion 34 configured to cover a portion of the lateral side of the user's calf and ankle, and a rear portion 36 configured to cover a portion of the rear side of the user's calf and Achilles tendon. In the depicted embodiment, these portions work together to form a boot shaft.

In the depicted embodiment, the upper 14 includes pull-on loops 38 that facilitate pulling on the boot 10. The boot 10 in the depicted embodiment is devoid of a manual mechanism for adjusting the foot fitting volume. For example, it has no laces, buckles, or zippers that can be used to expand or constrict the foot and leg volume of the boot 10. It should be appreciated that many alternative embodiments are possible. Some alternative embodiments may include a manual mechanism for adjusting the foot fitting volume. The feature of present disclosure can be incorporated into boots that are hybrid style boots with the option of pulling on but also have foot volume adjustment mechanisms. The features could also be incorporated into boots that are not designed to be pull-on.

In the depicted embodiment, the boot 10 includes expansion panels on both the lateral and medial side portions 32, 34 of the lower leg covering portion 22 of the boot. Each expansion panel includes a panel 40, 42 constructed of leather and an expansion insert 44, 46 constructed of an elastic material. In the depicted embodiment, the expansion insert 44, 46 forms an arched shaped configuration and is attached to the panel 40, 42 along a periphery edge of the panel 40, 42. The expansion insert 44, 46 connects the panel 40, 42 to the lower leg covering portion 22 of the boot 10 in a manner that allows the panel 40, 42 to stretch away from the boot 10. In the depicted embodiment, the expansion insert 44, 46 is stitched to the periphery of the panel 40, 42 and also stitched to the lower leg portion 22 of the boot 10. It should be appreciated that many other alternative configurations are possible.

In the depicted embodiment, the panel 40, 42 includes a front portion 66, an upper portion 68, a rear portion 70, and a bottom portion 72. In the depicted embodiment, the bottom portion 72 is connected to the foot covering portion 20. The connection between the bottom portion 72 and the foot covering portion 20 is inelastic. In the depicted embodiment, the connection at the bottom portion 72 is leather stitched to leather. In the depicted embodiment, the front portion 66 and the rear portion 70 of the panel 40, 42 are connected to the lower leg covering portion 22 via the expansion insert 44, 46. The expansion insert is arranged generally vertical along the front portion 66 and rear portion 70 of the panel. The top portion 68 of the panel 40, 42 is arched and connected to the lower leg covering portion 22 via the expansion insert 44, 46. The expansion insert is generally curved in the shape of an upside down U along the top portion 68 of the panel 40, 42. In the depicted embodiment the expansion insert is continuous and runs under the pull tabs of the boot. As discussed above, the expansion inserts 44, 46 extend below a top portion of the instep covering portion 28 of the foot covering portion 20. In the depicted embodiment, the expansion inserts 44, 46 are single strips of elastic material. Alternatively, each of the inserts 44, 46 could be constructed of multiple pieces of resilient material.

In the depicted embodiment, a portion of the expansion insert 44, 46 extends below at least a portion of the instep covering portion 28 thereby defining an expandable instep portion 48 there between. In the depicted embodiment, the portion of the expansion insert 44, 46 that extends below the instep covering portion 28 defines a teardrop shaped termination 50, 52. In the depicted embodiment, the expandable instep portion 48 can be displaced at least 0.25 inch from its original un-stretched state. The displacement can be measured outwardly from a reference point on a certral vertical axis inside the boot 10. In an alternative embodiment, the lower portion of the expansion insert 44, 46 is not teardrop shaped yet still allows for sufficient stretch in the instep area. In one alternative embodiment, the lower end portion is wider than the upper portion of the expansion insert 44, 46. In another alternative embodiment, the location of the stitching of the expansion insert 44, 46 in the instep area is moved back from the edges to effectively create a wider functional expansion insert 44, 46 in that area. Many other configurations are also possible.

In the depicted embodiments, the material of the expansion insert 44, 46 (second material) is a material that can be stretched to at least 150% of its original dimension and naturally return back to its original dimension (e.g., 10 millimeters stretches to 15 millimeters). In other embodiments, the second material can be stretched to at least 200% of its original dimension and naturally return back to its original dimension (e.g., 10 millimeters stretches to 20 millimeters).

Figure 6:
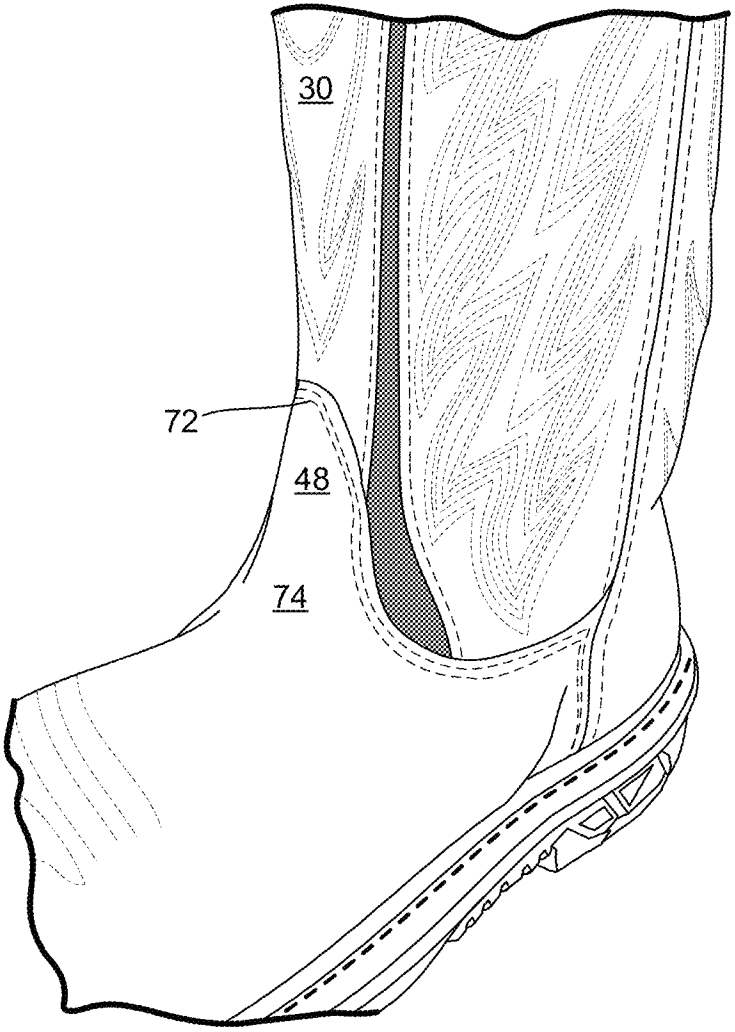
FIG. 6 is a front isometric view of the boot of FIG. 1 in a partially expanded state.
Figure 5:
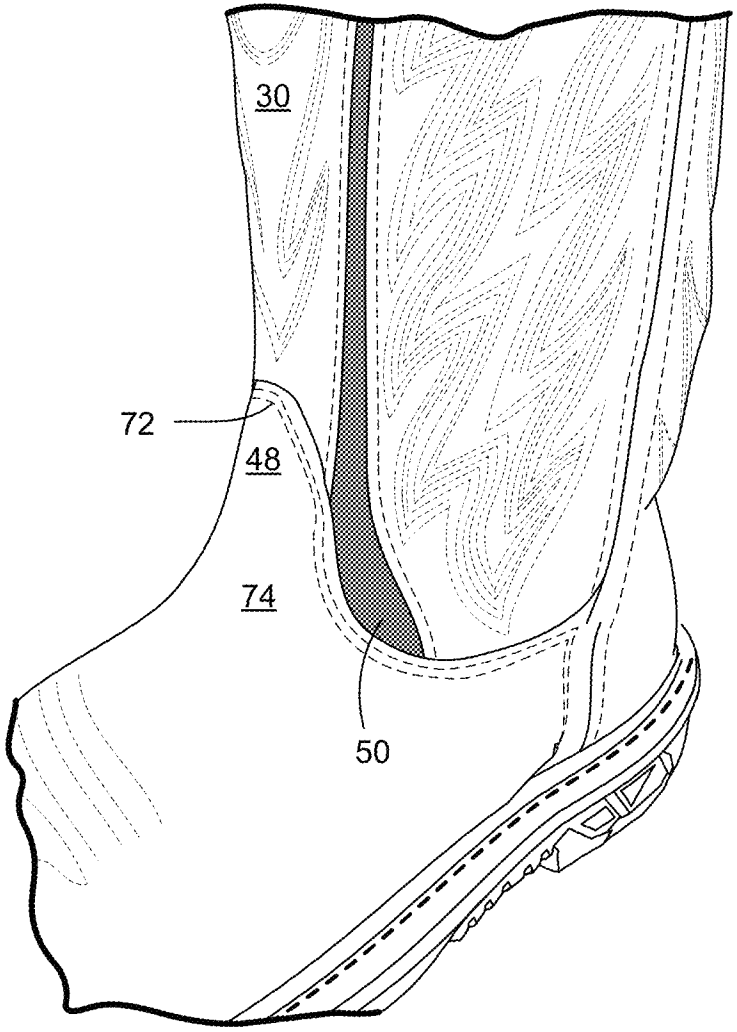
FIG. 5 is a front isometric view of the boot of FIG. 1 in a relaxed state.
Figure 8:
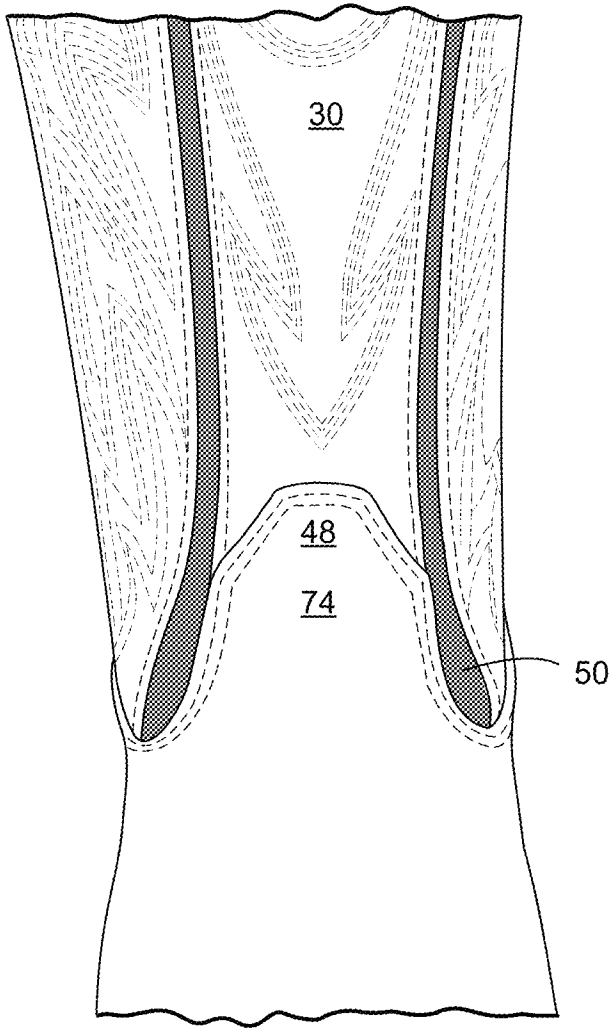
FIG. 8 is a front view of the boot of FIG. 1 in a partially expanded state.
Figure 7:
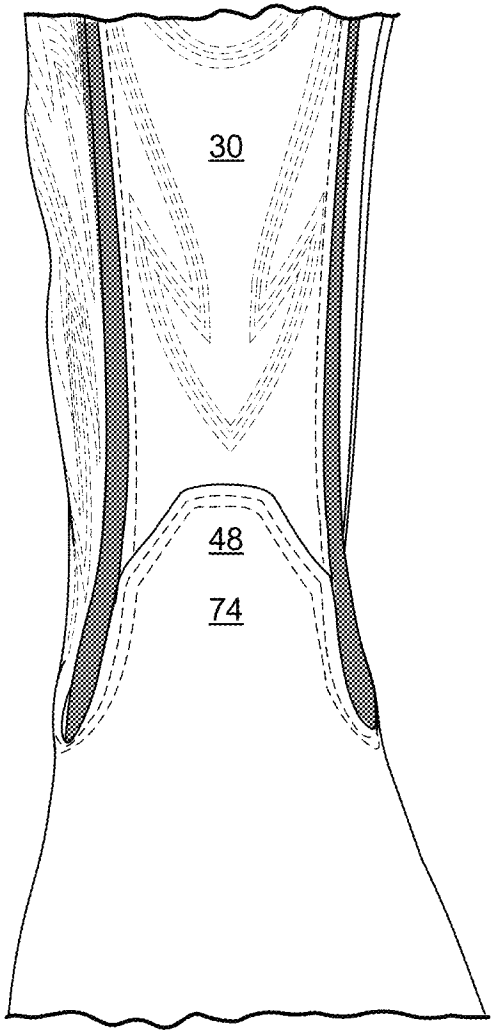
FIG. 7 is a front view of the boot of FIG. 1 in a relaxed state.

Referring to FIGS. 5 and 7, the boot 10 is shown in a relaxed state. Referring to FIGS. 6 and 8, the boot 10 is shown in a partially expanded or stretched state. The partially expanded states can represent a state in which the user's foot is being inserted or withdrawn from the boot thereby expanding the shaft of the boot 10. Alternatively, the partially expanded state can also represent a state in which a user's foot is seated in the boot 10 wherein the user has a foot volume that is relatively larger than the median foot volume. It could also represent a state where the user's foot is seated in the boot 10 and the user's instep is relatively higher than the median instep height for people with that particular boot size. The side by side view of FIGS. 5 and 6 and FIGS. 7 and 8 illustrate how the boot can facilitate foot entry and exit as well as how the boot has the ability to accommodate and provide an improved dynamic fit for people of a particular shoe size.

In the depicted embodiment, the potential stretch at the lower leg portion 22 of the upper 14 at girth A-B (FIG. 4), which is at the narrowest portion of the boot shaft, is at least one inch. This ability for the boot to stretch in essentially all directions and return to its original un-stretched shape facilities foot entry and exit. The expansion inserts 44, 46 expand to enable a 360 degree stretch of the boot shaft. In the depicted embodiment, the stretching is actually occurring in areas of the boot 10 that see less friction against the user's foot. This results in a system that is more comfortable as the common contact surfaces (front and rear areas of the boot shaft) are smooth and more durable. It should be appreciated that many other configurations are also possible.

In the depicted embodiment, the boot 10 is waterproof. In the depicted embodiment, the boot 10 includes a waterproof lining 60. In the depicted embodiment, the lining 60 includes three portions. A lower portion 62 that is non-stretch, a stretch portion 64 above the lower portion 62 is configured to stretch to allow the circumference of the lower leg portion 22 to increase at least one inch, and an upper collar lining 66 that is non-stretch. The stretch portion 64 works together with the expandable panels 40, 42 to allow for stretch in the boot 10. It should be appreciated that many alternative liner configurations are possible. In some embodiments the liner can be waterproof.

In should be appreciated that in some embodiments the boot 10 may include a single side expansion panel 40, 42 rather than both a medial and a lateral side expansion panel 40, 42. It should be appreciated that in alternative embodiments the boot upper 14 may be constructed of materials other than leather (e.g., TPU, Nylon, neoprene, etc.). The boot upper 14 can also be constructed of inelastic or partially elastic materials or a combination of such materials. It should be appreciated that the expansion inserts 44, 46 can be constructed of other stretch resilient materials other than elastic material. In alternative embodiments, the expansion panels 40, 42 can have different shapes and be located at different places on the boot 10.

In one alternative embodiment, the side expansion panel 40, 42 includes a panel 40, 42 that is entirely bounded by the expansion inserts 44, 46. For example, the expansion inserts 44, 46 could be oval shaped rather than arched shaped. In such an embodiment, the bottom edge portion of the panel 40, 42 can stretch away from the upper 14 as it would not be directly stitched to the upper 14 as shown. In other alternative embodiments, the expansion inserts 44, 46 are only located at the front, top and bottom, thereby defining a C-shaped expansion panel 40, 42. Many other configurations are possible.

In the depicted embodiment, the front portion 30 of the boot 10 includes tongue 74 that terminates in a crown 72. This is common in western style boot construction. In the depicted embodiment, the tongue 74 is a single piece of leather and provides a durable structure that facilitates smooth inserting of the user's foot. The expansion inserts 44, 46 extend downwardly on either side of the tongue 74. The tongue 74 is configured to flex forwardly as necessary. It is configured to provide soft even pressure on the instep on users with higher than the average instep. In the depicted embodiment, the center of the front portion 30 and center of the rear portion 36 is constructed of a single piece of leather. This construction provides durability and facilitates smooth insertion and removal of the user's foot.

The above specification, examples and data provide a complete description of the manufacture and use of the composition of the invention. Since many embodiments of the invention can be made without departing from the spirit and scope of the invention, the invention resides in the claims hereinafter appended.

What is claimed is:

1. A boot comprising:

a sole;

an upper, the upper including a foot covering portion connected to the sole and a lower leg covering portion located above the foot covering portion;

wherein the foot covering portion includes a toe covering portion, a heel covering portion, and an instep covering portion, the foot covering portion having a leather construction;

wherein the lower leg covering portion includes a front portion configured to cover a portion of a user's shin, a medial side portion configured to cover a portion of the medial side of the user's calf and ankle, a lateral side portion configured to cover a portion of the lateral side of the user's calf and ankle, and a rear portion configured to cover a portion of the rear side of the user's calf and Achilles tendon, wherein the lower leg covering portion forms at least a part of a boot shaft that defines an opening for receiving a user's foot;

expansion panels on each of the lateral and medial side portions of the lower leg covering portion, wherein each expansion panel includes a primary side panel constructed of leather and an expansion insert constructed of an elastic material, wherein the primary side panel constructed of leather is connected to the foot covering portion of the upper at a bottom portion of the primary side panel;

wherein each of the medial side portion and the lateral side portion of the lower leg covering portion defines an arch-shaped edge in the shape of an upside down U, wherein each primary side panel constructed of leather also defines an arch-shaped edge in the shape of an upside down U, and wherein each expansion insert constructed of elastic material is positioned between and attached to both the arch-shaped edge defined by the lower leg covering portion and the arch-shaped edge defined by the primary side panel in a manner that allows the primary side panel to stretch away from the lower leg covering portion of the upper; and wherein a portion of each expansion insert extends below at least a portion of the instep covering portion defining an expandable instep portion.

2. The boot of claim 1, wherein the circumference of the lower leg portion can be stretched at least 1 inch and return back to its original un-stretched state.

3. The boot of claim 2, further comprising a lining, wherein the lining is configured to stretch to allow the circumference of the lower leg portion to increase at least 1 inch.

4. The boot of claim 1, wherein at least a top portion of the expandable instep portion can be displaced at least 0.25 inch from its original un-stretched state.

5. A boot comprising:

a sole;

an upper, the upper including a foot covering portion connected to the sole and a lower leg covering portion located above the foot covering portion;

wherein the foot covering portion includes a toe covering portion, a heel covering portion, and an instep covering portion;

wherein the lower leg covering portion includes a front portion configured to cover a portion of a user's shin, a medial side portion configured to cover a portion of the medial side of the user's calf and ankle, a lateral side portion configured to cover a portion of the lateral side of the user's calf and ankle, and a rear portion configured to cover a portion of the rear side of the user's calf and Achilles tendon, wherein the lower leg covering portion forms at least a part of a boot shaft that defines an opening for receiving the user's foot; and a first expansion panel, the first expansion panel located on at least one of the medial side portion or the lateral side portion of the lower leg covering portion, the first expansion panel including a first side panel constructed of a first material and a first expansion insert constructed of a second material, the second material being more resilient than the first material, wherein the first side panel constructed of the first material is connected to the foot covering portion of the upper at a bottom portion of the first side panel, wherein at least one of the medial side portion and the lateral side portion of the lower leg covering portion defines an arch-shaped edge in the shape of an upside down U, wherein the first side panel constructed of the first material also defines an arch-shaped edge in the shape of an upside down U, and wherein the first expansion insert constructed of the second material is positioned between and attached to both the arch-shaped edge defined by the lower leg covering portion and the arch-shaped edge defined by the first side panel in a manner that allows the first side panel to stretch away from the lower leg covering portion of the upper.

6. The boot of claim 5, wherein the boot is a pull-on boot.

7. The boot of claim 5, further comprising a second expansion panel, the second expansion panel located on the medial side portion of the lower leg covering portion, the second expansion panel including a second side panel constructed of a first material and a second expansion insert constructed of a second material, wherein the second expansion insert is positioned between at least a portion of a periphery of the second side panel and the lower leg covering portion of the boot, the second material of the second expansion insert being more resilient than the first material of the second side panel, wherein the first expansion panel is located on the lateral side portion of the lower leg covering portion of the boot.

8. The boot of claim 7, wherein the first expansion insert is located on a front portion of the lateral side portion and extends below at least a portion of the instep covering portion and the second expansion insert is located on a front portion of the medial side portion and extends below at least a portion of the instep covering portion thereby defining an expandable instep portion between the first expansion insert and the second expansion insert.

9. The boot of claim 5, wherein the first material is inelastic.

10. The boot of claim 5, wherein the first material is leather.

11. The boot of claim 5, wherein the second material can be stretched to at least 150% of its original dimension and naturally return back to its original dimension.

12. The boot of claim 5, wherein the second material can be stretched to at least 200% of its original dimension and naturally return back to its original dimension.

13. The boot of claim 5, wherein the first side panel includes a front portion, an upper portion, a rear portion, and the bottom portion.

14. The boot of claim 13, wherein the bottom portion is connected to the foot covering portion, wherein the connection between the bottom portion and the foot covering portion is inelastic.

15. The boot of claim 13, wherein the first expansion insert is positioned between the lower leg portion and both of the front and rear portions of the first side panel.

16. The boot of claim 15, wherein the first expansion insert extends below a top portion of the instep portion of the foot covering portion.

17. The boot of claim 16, wherein the first expansion insert is positioned between the upper portion of the first side panel and the lower leg portion.

* * * * *